United States Patent [19]

Sell

[11] Patent Number: 4,590,429

[45] Date of Patent: May 20, 1986

[54] NONDESTRUCTIVE MEASUREMENT OF OXYGEN LEVEL IN A TUNGSTEN-HALOGEN INCANDESCENT BULB

[75] Inventor: Jeffrey A. Sell, Huntington Woods, Mich.

[73] Assignee: General Motors Corporation, Detroit, Mich.

[21] Appl. No.: 552,251

[22] Filed: Nov. 16, 1983

[51] Int. Cl.[4] ..... H01J 9/42

[52] U.S. Cl. ..... 324/414

[58] Field of Search ..... 356/36, 336, 338, 339, 356/311, 312, 318; 313/578, 579; 324/414; 340/642, 643; 315/105

[56] References Cited

U.S. PATENT DOCUMENTS

| | | | |
|---|---|---|---|
| 2,664,543 | 12/1953 | Thayer | 324/414 |
| 3,249,859 | 5/1966 | Speros | 324/414 |
| 3,569,766 | 3/1971 | Larson | 313/579 |
| 4,005,324 | 1/1977 | Dolenga | 313/579 |
| 4,037,964 | 7/1977 | Wertheimer | 356/336 |
| 4,053,229 | 10/1977 | McCluney | 356/338 |

*Primary Examiner*—Reinhard J. Eisenzopf
*Assistant Examiner*—G. Peterkin
*Attorney, Agent, or Firm*—George A. Grove

[57] ABSTRACT

A previously unlit tungsten filament bulb with a fill gas is flashed for about one second to form a dispersion of tungsten oxide particles therein. In a preferred embodiment, a laser beam is passed through the dispersion and the scattered light is detected to provide a measure of the oxygen content of the bulb.

2 Claims, 2 Drawing Figures

NONDESTRUCTIVE MEASUREMENT OF OXYGEN LEVEL IN A TUNGSTEN-HALOGEN INCANDESCENT BULB

This invention relates to a quality control method of monitoring oxygen content in newly manufactured tungsten-halogen bulbs. More particularly, it relates to a nondestructive method of estimating the quantity of tungsten oxide particles dispersed in a newly manufactured bulb.

Tungsten-halogen bulb assemblies are now well known and are used commercially in automobile lamps. The bulbs comprise a transparent envelope or capsule of suitable glass composition. An aluminosilicate composition, for example, is used. One or more tungsten metal filaments are employed in the bulb. A carrier gas comprising krypton (or other suitable inert gas) and a halogen gas is employed. Examples of halogen carrier constituents are bromine, hydrogen bromide, fluorine and compounds of fluorine and bromine, such as bromotrifluoromethane. The bulb is sealed to enclose the tungsten filaments and carrier gas, and to exclude the atmosphere.

It is known that when electric current is passed through the tungsten filament it becomes extremely hot, and tungsten evaporates and deposits on the inside wall of the glass bulb. This darkens the bulb and shortens the life of the filament. The presence of halogen in the fill gas in a suitable quantity results in a series of tungsten and halogen reactions which redeposits evaporated tungsten on the filament and on the lead wires, thus maintaining clear bulb walls. This allows the envelope to be made smaller and the pressure of the fill gas increased. The bulb then has increased life and luminosity.

In some tungsten-halogen bulbs oxygen is desired as a constituent of the fill gas. Neumann U.S. Pat. No. 3,783,328 and Dolenga and Hill U.S. Pat. No. 4,005,324 disclose fill gas compositions comprising fluorine and oxygen in approximately equal atomic proportions. During operation of these bulbs it is believed that tungsten oxyhalide compounds are formed which are particularly effective in maintaining clear walls. In other bulbs with different fill gases, oxygen may be detrimental to bulb performance due to the formation of tungsten oxides which consumes tungsten from the filament and blackens the bulb wall. Whether oxygen is desired in the fill gas or not, it is difficult to exclude it completely from the bulb. It is also difficult to measure the oxygen content in the bulb.

It is an object of my invention to provide a method of estimating or monitoring the oxygen content in a tungsten filament bulb which has not been previously lit.

It is a more specific object of my invention to provide a nondestructive method of measuring the amount of tungsten oxide particles dispersed in the carrier gas of a tungsten-halogen bulb when it is lit for the first time. The amount of tungsten oxide so formed provides a measure of the oxygen present in the bulb.

BRIEF SUMMARY

In accordance with a preferred embodiment of my invention, these and other objects and advantages are accomplished as follows.

An example of a tungsten-halogen lamp is one comprising one or more tungsten filaments and a fill gas of krypton, about 200 to 600 parts per million bromotrifluoromethane and some oxygen. The fill gas may be present in the bulb under an absolute pressure of up to about 7 atmospheres. I have found that when such a bulb is first made and the filaments are flashed (i.e., an electrical current passed through them for about one second), a cloud or dispersion of particles is formed. The particles have been identified as one or more tungsten oxides. The dispersion soon settles and is rarely, if ever, formed again during the use of the bulb. However, the tungsten oxide particles are believed to contain, at least temporarily, a major portion of the oxygen initially in the lamp. Thus, the density of dispersed particles is proportional to original oxygen content of the bulb.

I have passed a beam of highly directional and monochromatic light through the dispersion. A suitable light, for example, is that formed by a helium-neon laser of one milliwatt power. The laser light is strongly scattered. The amount of scattered light is proportional to the amount of tungsten oxide dispersed and can easily be measured as, for example, by a suitable photon detecting device. It is possible, by exacting measurements, to estimate closely the amount of tungsten oxide so dispersed in the bulb. However, for industrial quality control purposes this is not necessary. The amount of light scattered in the nondestructive test can simply be compared with the amount of light scattered by the like means from like bulbs which are known to contain a suitable amount of oxygen.

DESCRIPTION OF THE DRAWINGS

Other objects and advantages of my invention will become apparent from a detailed description thereof which follows. Reference will be made to the drawings, in which.

DETAILED DESCRIPTION

Figure 1:
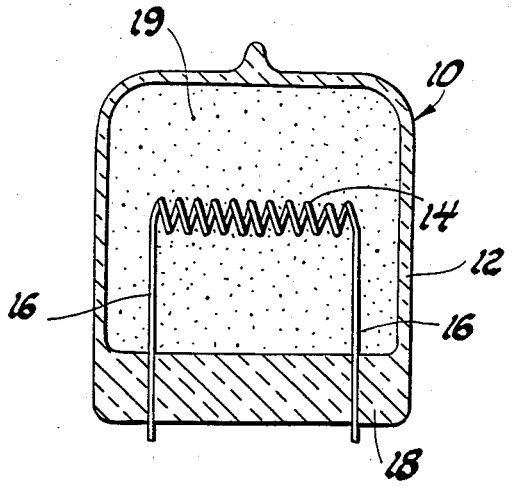
FIG. 1 is a side view of a tungsten-halogen bulb containing a single tungsten filament and illustrating the dispersion of tungsten oxide particles during the initial flashing of the filament.

In FIG. 1 is shown a tungsten-halogen bulb 10 comprising, for example, an aluminosilicate glass envelope 12. Within the transparent envelope is a fill gas, not visible. A suitable fill gas, for example, comprises krypton, a few hundred parts per million bromotrifluoromethane and a few hundred parts per million oxygen. The fill gas was under a pressure of 7 atmospheres. Also enclosed are one or more tungsten filaments 14 supported on leads 16 which exit the envelope through a sealed base portion 18. Obviously, such bulbs are made in a wide variety of envelope configurations, filament configurations and fill gas compositions. The details of the bulb construction and fill gas content are not critical to the practice of my invention so long as the bulb has a tungsten filament and a buffer gas that may contain oxygen.

My method is applied to a bulb which has not been previously lit. Current is passed through the filament at its rated capacity for a period of about one second. During this period, tungsten oxide that is initially on the tungsten filament is thermally desorbed in the form of a cloud 19 of very fine particles. So long as there is a fill gas in the bulb, the particles are dispersed like a snow cloud within the bulb. The dispersion remains for several minutes. Where there is additional oxygen (apart from that contained in the initial tungsten oxide) in the bulb, it rapidly reacts with the extremely hot tungsten surface. Additional oxide is formed and it also is thermally desorbed and becomes a part of the dispersion. It is believed that in this initial flashing of the tungsten filament substantially all of the oxygen within the bulb is at least temporarily converted to an oxide of tungsten.

The formation of the particulate dispersion 19 has only been observed to occur during the first lighting of the bulb. After the dispersion settles I have been unable to reform it by shaking the bulb or relighting the bulb. While the dispersion exists there is the opportunity for a nondestructive evaluation of the oxide and thus oxygen content of the bulb. This practice will be described in detail below.

In order to satisfy myself as to the chemical identity of the dispersed particles, scanning electron microscope (SEM) pictures were taken of them after they had settled on the glass walls. In addition, electron diffraction patterns were prepared. The energy analysis of the emitted x-rays from the scanning electron microscope examination indicated that the particles contained tungsten. The d-spacings determined from electron deflection were a good match to $W_{18}O_{49}$ (or $WO_{2.72}$). This oxide is one of the several nonstoichiometric oxides of tungsten known to exist. Most likely a mixture of different tungsten oxides is present and the fact that the d-spacings match $W_{18}O_{49}$ may mean that this oxide is present in higher concentration than others.

The scanning electron microscope pictures revealed particles in a range of sizes from much less than 1 $\mu$m to about 10 $\mu$m. A higher magnification SEM showed that the particles were composed of many spherules, about 0.05 $\mu$m in diameter, which stuck together to form stringy, irregularly shaped particles.

Figure 2:
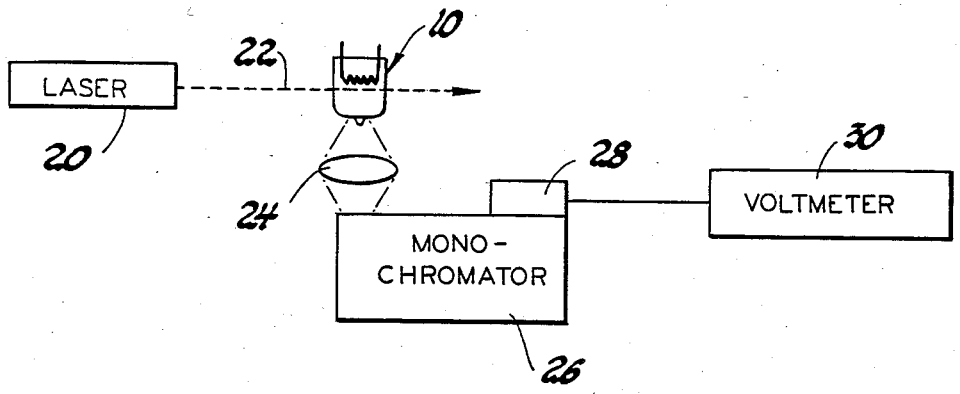
FIG. 2 is a schematic representation of instrumentation suitable for measuring the amount of laser light scattered by the tungsten oxide cloud.

I obtain a measure of the quantity of oxide particles in dispersion by measuring the scattering of a laser beam as follows. The apparatus is depicted schematically in FIG. 2. The bulb was placed in a holder (not shown) and the filament was flashed for about one second. While the bulb 10 was still in this holder the beam 22 of a low power (1 mw) He-Ne laser 20 was directed through it. Solid particles of tungsten oxide floating inside the bulb strongly scattered the red laser light. The path of the light could be clearly seen. Scattered light from the one side of the bulb was collected by a lens 24 and sent through the ¼m monochromator 26. The monochromator filtered off extraneous light and the radiation was then directed into a photomultiplier tube 28, which generated a current proportional to the scattered light. The current was directed through a resistor, across which voltmeter 30 was connected to obtain a voltage indicative of the intensity of the scattered light.

The particles floating in the bulb gradually settle, and after about one-half hour the scattered laser beam can no longer be seen inside the bulb. The higher the oxygen content of the bulb, the more dense the dispersion and the more that an incident light beam is scattered. The denser dispersions of particles settle faster. However, if the light scattering measurement is conducted immediately after flashing the filament, reliable comparative data can be obtained from a number of bulbs. By using my apparatus of FIG. 2 or an equivalent photon detectng device, a measurement of the tungsten oxide, and thus oxygen content, of the bulb can be obtained. A higher voltage reading, of course, indicates a greater oxygen content.

This practice can be performed on representative samples of tungsten filament bulbs having a buffer gas immediately after they are manufactured. Lifetime and luminosity experience can be obtained from bulbs on which the light scattering measurements are made, and specified values for the light scattering can be correlated with such bulb performance. In this way, nondestructive tests can be made at a bulb production line and an immediate determination made as to whether the oxygen content of the newly manufactured bulbs is comparable to like bulbs that have been found to be satisfactory.

While my invention has been described in terms of a specific embodiment thereof, it will be appreciated that other forms could readily be adapted by one skilled in the art. Accordingly, the scope of my invention is intended to be limited only by the following claims.

The embodiments of the invention in which an exclusive property or privilege is claimed are defined as follows:

1. A method of determining whether the oxygen content of a fill gas of a tungsten filament-halogen incandescent light bulb with a transparent envelope meets a predetermined standard, comprising passing a current through the tungsten filament of a previously unlit bulb for a short period of time to disperse particles of tungsten oxide in the fill gas of the bulb, immediately directing a beam of monochromatic light through the dispersed particles whereby some of the light is scattered, detecting the amount of light scattered in a particular direction, and comparing such value with data obtained in a like manner from bulbs known to have a suitable oxygen content.

2. A method of determining whether the oxygen content of a tungsten filament, transparent envelope incandescent light bulb containing a gas meets a predetermined standard, comprising passing a current through the tungsten filament of a previously unlit bulb for a period of time sufficient to react oxygen in the gas with the tungsten and to disperse particles of tungsten oxide in the gas of the bulb, immediately directing a beam of monochromatic light through the dispersed particles whereby some of the light is scattered, detecting the amount of light scattered in a particular direction, and comparing such value with data obtained in a like manner from bulbs having a suitable oxygen content.

* * * * *